United States Patent [19]

Steinbach

[11] 4,227,387

[45] Oct. 14, 1980

[54] AXIAL SPLIT-PIN TUMBLER-TYPE LOCK MECHANISM

[75] Inventor: Robert L. Steinbach, Glendale Heights, Ill.

[73] Assignee: Chicago Lock Co., Chicago, Ill.

[21] Appl. No.: 968,438

[22] Filed: Dec. 11, 1978

[51] Int. Cl.[2] ..... E05B 27/08

[52] U.S. Cl. ..... 70/363; 70/419

[58] Field of Search ..... 70/363, 416, 419

[56] References Cited

U.S. PATENT DOCUMENTS

| | | | |
|---|---|---|---|
| 1,479,305 | 1/1924 | Lee | 70/363 |
| 1,755,847 | 4/1930 | Stevens | 70/421 |
| 1,854,080 | 4/1932 | Tonnessen | 70/363 |
| 2,050,096 | 8/1936 | Schoorel | 70/95 |
| 2,618,957 | 11/1952 | Tonnessen | 70/363 |
| 3,270,538 | 9/1966 | Kerr | 70/363 |

*Primary Examiner*—Robert L. Wolfe

*Attorney, Agent, or Firm*—Gerlach & O'Brien

[57] ABSTRACT

An axial split-pin tumbler-type lock mechanism having improved pick-resistance is provided with tumblers having substantially the same overall length, at least two of the tumblers having driver elements differing in length, and with spring means in at least two different spring rates respectively to act upon the tumblers having elements differing in length, one of the spring means which has a relatively high spring rate acting upon a tumbler having a relatively short driver element, and another of the spring means which has a relatively low spring rate acting upon a tumbler having a relatively long driver element.

11 Claims, 7 Drawing Figures

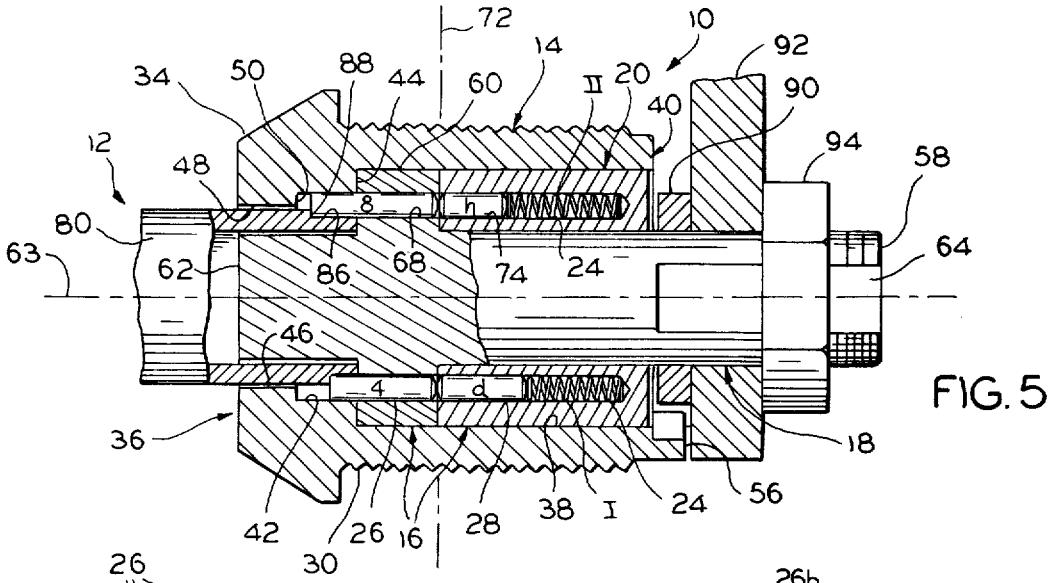
FIG. 5
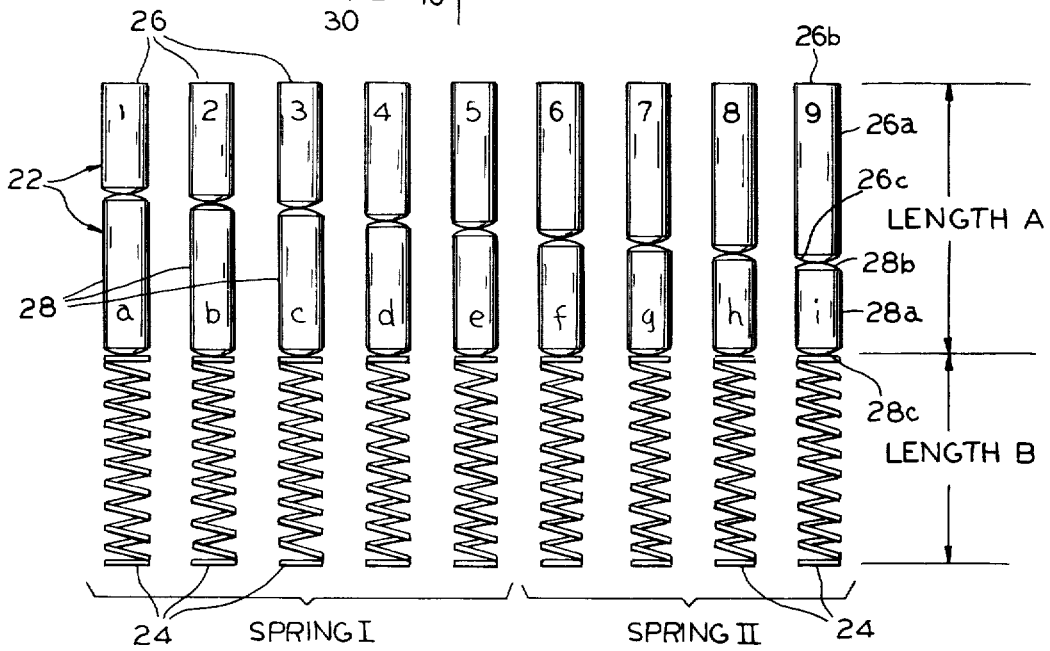
FIG. 6
CODE EXAMPLE
7-TUMBLER LOCK
| | | | | | | | |
|---|---|---|---|---|---|---|---|
| DRIVER ELEMENT | 6 | 2 | 6 | 4 | 2 | 3 | 8 |
| FOLLOWER ELEMENT | f | b | f | d | b | c | h |
| SPRING | II | I | II | I | I | I | II |
FIG. 7

AXIAL SPLIT-PIN TUMBLER-TYPE LOCK MECHANISM

BACKGROUND OF THE INVENTION

This invention relates to axial split-pin tumbler-type lock mechanisms, particularly, to a lock mechanism having increased pick-resistance.

In general, the axial split-pin tumbler-type lock mechanisms include a rotatable operating part and a stationary part, which adjoin at an interfacial plane. Tumblers each including a driver element and a follower element are mounted in bores in the parts which meet in alignment at the interfacial plane, and the tumblers are movable back and forth in the aligned bores. When the interfacial plane is bridged by one or more of the tumbler elements, the operating and stationary parts thereby are secured against rotation relative to each other. When the joints between the tumbler elements coincide with the interfacial plane on insertion of the proper key, the operating part may be rotated by means of the key, to accomplish a desired function. Kerr U.S. Pat. No. 3,270,538 is illustrative of one form of lock mechanism to which the present invention is directed.

The lock mechanisms commonly are picked with what may be referred to as a "gang pick," of the type disclosed in the foregoing patent. The pick is applied to a lock mechanism, a rotational torque or bias is applied to the operating part by the pick, to displace the operating part to a slight extent relative to the stationary part, and a back and forth jiggling motion is utilized to catch tumbler elements on tumbler bore margins which project over previously aligned adjoining bores, until elements of all of the tumblers have been caught at the interfacial plane and the operating part is free to rotate, the mechanism then being in an unlocking condition.

The aforesaid patent discloses the provision of tumbler-biasing springs which vary among themselves in their spring rates or strengths. The differences in the spring rates are responsible for altering the manner in which the tumblers move when the lock pick is used, thereby interfering with the intended operation of the pick. While the sole provision of springs having different rates increases the pick-resistance of the lock mechanisms in this manner, certain techniques have, nevertheless, been found to enable a skilled operator to open the lock mechanisms with a pick of the type shown in the patent.

SUMMARY OF THE INVENTION

The present invention provides improvements in an axial split-pin tumbler-type lock mechanism which increase the pick-resistance thereof, the improved lock mechanism thereby being especially adapted to resist picking with the common gang-type pick, such as the pick illustrated in the above-identified U.S. Pat. No. 3,270,538.

An axial split-pin tumbler-type lock mechanism to which the invention is directed includes a lock cylinder, a barrel assembly secured within the cylinder and having a longitudinal axis extending between front and rear ends thereof, the barrel assembly including a forwardly disposed operating part rotatable about the axis and a rearwardly disposed stationary part adjoining the operating part at a transverse interfacial plane, means forming longitudinal bores in the operating and stationary parts, respectively, and disposed radially outwardly of the axis therearound, such bore-forming means in respective parts being relatively movable into and out of longitudinal alignment of their bores upon rotation of the operating part, tumblers each including a forwardly disposed driver element carried in one of such operating part bores and a separate rearwardly disposed follower element carried in one of such stationary part bores with the elements adjoining each other when in aligned bores, the tumblers each being reciprocally movable in the axial direction in aligned bores between respective positions wherein the joint between the tumbler elements is disposed on opposite sides of the interfacial plane, the operating and stationary parts being secured against rotation relative to each other when at least one of the tumbler elements bridges the interfacial plane, and being rotatable relative to each other when the tumbler joints coincide with the interfacial plane, and spring means yieldingly urging the tumblers in aligned bores forwardly to positions wherein the interfacial plane is bridged by a plurality of the follower elements, the driver elements having front ends engageable with a key, whereby rearward movement of the key moves the tumblers in aligned bores rearwardly to positions wherein the tumbler joints coincide with the interfacial plane.

In accordance with the invention, increased pick-resistance is achieved by providing tumblers which have substantially the same overall length, and include at least two tumblers having driver elements differing in length, and providing spring means which have at least two different spring rates respectively to act upon the tumblers having elements differing in length, one of the spring means which has a relatively high spring rate acting upon a tumbler having a relatively short driver element, and another of the spring means which has a relatively low spring rate acting upon a tumbler having a relatively long driver element.

Lock mechanisms having the foregoing combination of spring means having different spring rates, and equal length tumblers having different length tumbler elements, wherein a spring means of high spring rate is matched with a relatively short tumbler drive element, and vice versa, have proven to be at least exceptionally difficult to pick with the common picking tool of the type shown in the above-identified patent. One observed result is that there is a greater tendency for all of the tumblers to move outwardly in uniformity after being depressed initially by insertion of a pick, so that the operator cannot determine the locations of long and short driver pins as an aid to picking. With conventional locks, having springs all of one rate and the usual mix of tumbler elements, the tumblers may move outwardly during picking in a staggered relation resembling the key pattern.

While the accomplishment of the invention was largely empirical, it was found that certain sequences of tumbler movement tended to occur when picking conventional locks, and by matching spring rates with the tumblers in the manner described above, the tumbler movements could be altered. In particular, the tumbler movements could be made more uniform, to interfere with the modus operandi of the pick. Thus, it was found that tumblers having a longer overall length tended to move outwardly and be picked first, and with tumblers of equal length, those with longer driver pins tended to move outwardly and be picked first. In the invention, the former effect is eliminated by providing equal length tumblers, and the latter effect is effectively reduced by the above-described match-up of spring means having different rates and tumblers having driver elements of different lengths.

BRIEF DESCRIPTION OF THE DRAWINGS

The attached drawings illustrate a preferred embodiment of the lock mechanism of the invention, without limitation thereto. In the drawings, like elements are identified by like reference symbols in each of the views, and:

FIG. 5 is a view like FIG. 4 but showing a portion of the key of FIG. 1 inserted in the lock mechanism, to place it in an unlocking condition;

FIG. 6 illustrates the tumblers and tumbler springs used in the lock mechanism, in various combinations providing a corresponding variety of lock codes; and FIG. 7 illustrates by reference symbols a particular lock code for a 7-tumbler lock, wherein the tumbler elements and the springs are arranged in the manner represented by their symbols.

DESCRIPTION OF THE PREFERRED EMBODIMENT

Figure 2:
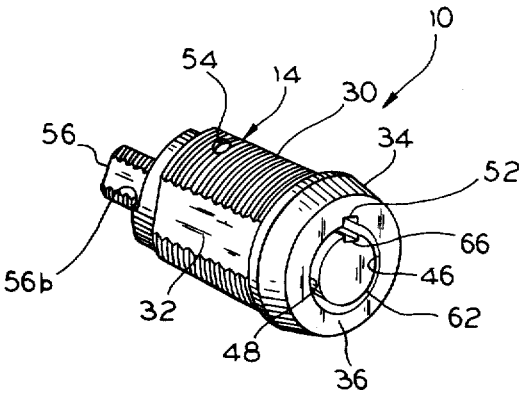
FIG. 2 is a front perspective view of a lock mechanism, in accordance with the invention.

Referring to the drawings, an axial split-pin tumbler-type lock mechanism or lock 10 is employed with a tubular key 12. The locking components of the lock mechanism and the key are, in general, similar to the corresponding structures of prior lock mechanisms of the same type, while employing a particular combination of components in accordance with the invention, as described hereinafter. The illustrative lock mechanism 10 operates a locking plate or cam structure, as described hereinafter, but may be used for other purposes, such as for the operation of switch components, in known manner.

Figure 3:
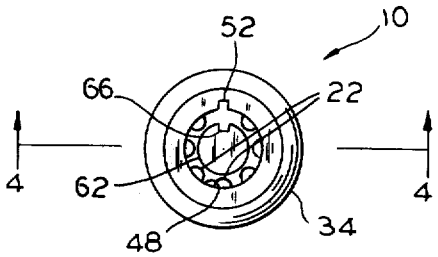
FIG. 3 is a front end elevational view of the lock mechanism.
Figure 4:
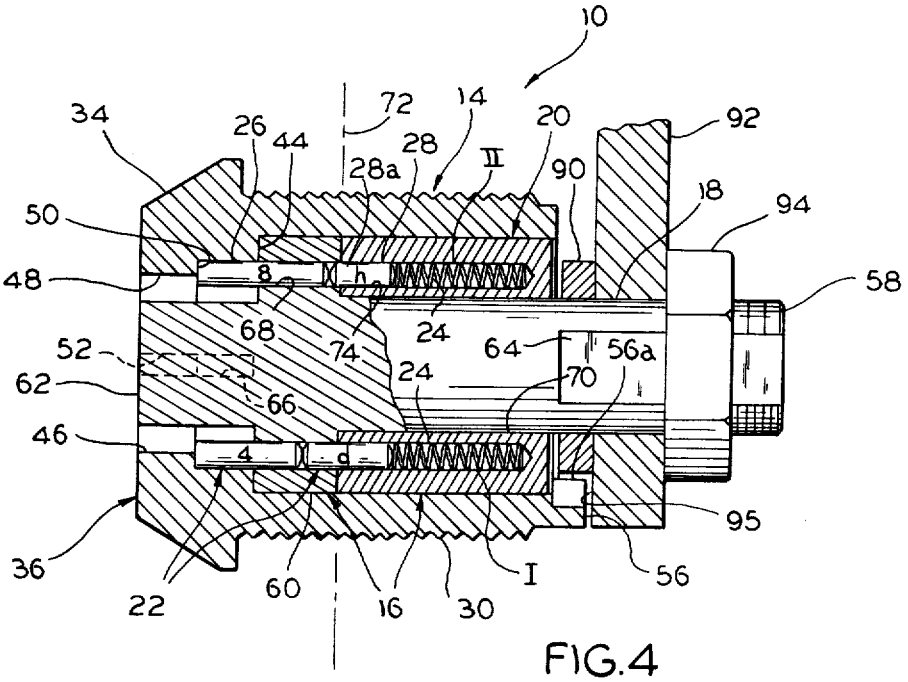
FIG. 4 is a longitudinal sectional view of the lock mechanism, taken substantially on line 4—4 of FIG. 3 and enlarged with respect thereto, an operating part thereof being illustrated partly in section and partly in elevation.

Referring especially to FIGS. 3–5, the lock mechanism 10 includes a lock cylinder 14 and a barrel assembly 16. The barrel assembly 16 includes a rotatable operating part or plug assembly 18 and a stationary part or sleeve member 20. The lock mechanism also includes a plurality of tumblers 22, which are seven in number, and a like number of tumbler springs 24. Each tumbler 22 is composed of a driver element or pin 26 and a follower or locking element or pin 28.

The lock cylinder 14 includes an elongated tubular threaded body 30 having a pair of flats 32 (FIG. 2) extending longitudinally on opposite sides thereof, and an enlarged frusto-conical head 34 integral with the body at the front or outer end 36 of the lock mechanism. The foregoing structure serves for mounting the lock mechanism 10 in a door or wall panel or the like and in a conventional manner. For example, the body 30 may be inserted through a corresponding opening in a panel, and a nut, not shown, is threaded thereon, for clamping the panel between the nut and the head 34.

The cylinder body 30 has a longitudinal cylindrical bore 38 (FIG. 5) extending forwardly from its rear end 40. A second longitudinal cylindrical bore 42 of reduced diameter is provided in the front end of the body 30 and in the head 34. A rearwardly facing annular barrel-retention shoulder or ledge 44 extends between the bores 38 and 42 where they terminate adjacent to each other. An annular closure flange 46 extends radially inwardly from the head 34 at the front end of the lock cylinder 14, and it defines a circular key opening 48. The closure flange 46 forms a rearwardly facing annular tumbler-retention shoulder or ledge 50 adjacent to the wall of the front bore 42. A key guide notch or groove 52 (FIGS. 2 and 4) extends in the closure flange 46 radially outwardly from its inner edge. A radial mounting hole 54 (FIG. 2) extends through the wall of the cylinder body 30. An arcuate longitudinal extension 56 is integral with the rear end 40 of the cylinder body 30, and stop shoulders **56*a* and 56*b*** (FIGS. 2 and 4) are formed by the opposite side edges thereof.

The operating part 18 includes a substantially cylindrical lock shaft 58, a cylindrical head 60 integral with the front end of the lock shaft and having a greater diameter than the shaft, and a substantially cylindrical guide post 62 integral with the front end of the head 60 and having a smaller diameter than the shaft 58. The several components of the operating part 18 have axes which coincide with a longitudinal axis 63 (FIG. 5) of the part, which axis is also the longitudinal axis of the complete barrel assembly 16, the stationary part 20, and the lock cylinder 14 when the lock mechanism 10 is assembled. While the illustrative operating part 18 is constructed integrally of the foregoing several components, any of the components may be separately constructed and secured to the remaining components by suitable means. In particular, it is advantageous frequently to construct the guide post 62 separately of harder material.

The lock shaft 58 is provided with a pair of diametrically opposed flats 64 at the rear end of the shaft. The guide post 62 is provided with a longitudinal drive notch or groove 66. Longitudinal cylindrical tumbler bores 68 of equal diameter extend through the head 60 of the operating part 18, and they are disposed radially outwardly of the lock shaft 58 at equal radii from the axis 63. The operating part bores 68 in the illustrative embodiment are seven in number, and they are spaced apart around the axis 63 at equal angles of 45°, except for two bores which are on opposite sides of the drive notch 66 and are spaced apart at an angle of 90°.

The operating part 18 is received in the lock cylinder 14 with the front face of its head 60 abutting on the barrel-retention shoulder 44. The guide post 62 is centrally disposed in the key opening 48 and is equidistantly spaced from the closure flange 46 therearound, to provide an annular keyway between the guide post and the closure flange. The guide post 62 terminates at its front end approximately at the plane of the face of the closure flange 46. The operating part 18 is rotatable in the lock cylinder 14 about the axis 63.

The stationary part 20 is a cylindrical tubular member having a cylindrical axial bore 70 in which the lock shaft 58 is journalled, and a front face which adjoins the rear face of the operating part head 60 at a transverse interfacial plane 72. The stationary part 20 is fixedly secured to the lock cylinder 14 in a conventional manner, thereby securing the barrel assembly 16 in the cylinder. Thus, a mounting pin, not shown, is force-fitted into the mounting hole 54 (FIG. 2) in the cylinder 14 and into an aligned pin-receiving hole, also not shown, in the stationary part 20.

Longitudinal cylindrical blind tumbler bores 74 of equal diameter extend longitudinally in the stationary part 20 and rearwardly from its front face. The stationary part bores 74 are seven in number, and they have diameters equal to the diameters of the operating part bores 68. The stationary part bores 74 are disposed radially outwardly of the lock shaft 58 at the same radius from the axis 63 and at the same angular spacing therearound as for the operating part bores 68, so that the tumbler bores 68 and 74 in the respective operating and stationary parts are relatively movable into and out of longitudinal alignment or register upon rotation of the operating part 20.

Referring especially to FIG. 6, the driver elements 26 and the follower elements 28 have substantially cylindrical bodies 26*a* and 28*a*, respectively, of the same diameter, which is slightly less than the diameter of the tumbler bores 68 and 74. It is preferred for maximum pick-resistance to limit any end projections from the bodies 26*a* and 28*a* to substantially spherically rounded crowns. In the illustrative embodiment, the body 26*a* of each driver element 26 has a planar front end 26*b*, adapted to seat on the tumbler-retention shoulder 50 of the lock cylinder 14 when assembled, as illustrated in FIG. 4. The body 26*a* of each driver element 26 also has an integral spherically rounded crown 26*c* on its inner end, which preferably constitutes a minor portion of a hemisphere. The body 28*a* of each follower element 28 is provided with like outer and inner spherically rounded crowns 28*b* and 28*c*, respectively, preferably constituting minor portions of hemispheres and having the same dimensions, to permit interchangability of the ends.

It is further preferred that any crown, such as the crowns 26*c*, 28*b*, and 28*c*, have a minimum radius of curvature of about 3/32", for maximum pick-resistance together with smooth operation of the lock. It is also preferred for smooth operation of the lock that the maximum radius of curvature of each crown be about ⅛". In the illustrative embodiment, the radius of curvature for each crown is 7/64". The foregoing and other specific numerical values disclosed herein are particularly applicable to the standard ⅝" and ¾" lock mechanism sizes, such dimensions referring to the diameter of the cylinder body 30.

In accordance with the invention, the tumblers 22, each consisting of a driver element 26 and a follower element 28, are provided in substantially equal overall lengths, as represented by the dimension identified as "LENGTH A" in FIG. 6. The tumblers 22 employed in each individual or specific lock mechanism 10 include at least two tumblers having driver elements 26 differing in length. FIG. 6 illustrates a series of nine tumblers 22, made up of nine driver elements 26 of different lengths, further identified specifically as numbers 1 through 9, and nine follower elements 28 of different lengths, specifically identified as letters a through i, from which series the tumblers 22 employed in a given individual lock mechanism are selected. Each lock code is made up of a different combination of tumblers 22 selected from the illustrative series, an exemplary combination of which is illustrated in FIG. 7. In this example, illustrative of a seven-tumbler lock, the tumblers are made up of five different combinations from the series illustrated in FIG. 6. Similarly, thousands of other combinations may be made up from the illustrative series of tumblers, to provide a corresponding number of lock codes, each operated by a different key 12.

As indicated above, at least two of the tumblers 22 in each individual lock mechanism 10 must be constituted of driver elements 26 of different lengths, with the follower elements 28 of the tumblers correspondingly or complementarily differing in length, so as to provide the same overall LENGTH A for all of the tumblers in the lock mechanism. In the illustrative preferred embodiment, the successive driver elements 26-1 through 26-9 have length dimensions increasing between successive elements a distance of about 0.015–0.017", while the corresponding follower elements 28-*a* through 28-*i* have lengths successively decreasing to the same extent as their complementary driver elements.

In the assembled lock mechanism 10, each driver element 26 is carried in one of the operating part bores 68, and each follower element 28 is carried in one of the stationary part bores 74, with the tumbler elements adjoining each other when in aligned bores 68 and 74. Each of the tumblers 22 is reciprocally movable in the axial direction in aligned tumbler bores 68 and 74, between respective positions wherein the joint between the tumblers elements is disposed on opposite sides of the interfacial plane 72. Thus, the tumblers 22 are movable between an outermost position, with their front ends abutting on the tumbler-retention shoulder 50 and with their joints disposed forwardly of the plane 72, as illustrated in FIG. 4, and an innermost position, not illustrated, wherein the tumbler joints are disposed rearwardly of the plane 72. The operating part 18 and the stationary part 20 are secured against rotation relative to each other when at least one of the tumbler elements 26 and 28 bridges the interfacial plane 72, as illustrated in FIG. 4, and the operating and stationary parts are rotatable relative to each other when all of the tumbler joints coincide with the interfacial plane 72, as illustrated in FIG. 5.

The tumbler springs 24 are helical coil compression springs, and one of the springs is seated at the closed end of each stationary part bore 74. The outer end of each spring 24 bears upon the rear end of a follower element 28, at the location of a crown 28*c*, and yieldingly urges the corresponding tumbler 22 in aligned bores 68 and 74 forwardly to a position wherein the interfacial plane 72 is bridged by the body portion 28*a* of the follower element, as illustrated in FIG. 4, to secure the operating part 18 and the stationary part 20 against rotation relative to each other.

The springs 24 in each individual lock mechanism 10 are provided in at least two different spring rates, respectively to act upon tumblers 22 having driver elements 26 differing in length. In the illustrative embodiment and as indicated in FIG. 6, two different springs, identified as "SPRING I" and "SPRING II," respectively, are employed with the nine tumblers 22 in the series. SPRING I has a high spring rate or strength relative to SPRING II. SPRING I is matched with the tumblers 22 having driver elements 26-1 through 26-5 which are short relative to the driver elements 26-6 through 26:9 of the remaining tumblers 22, for acting upon the former tumblers. SPRING II, having a low spring rate relative to SPRING I, is matched with the tumblers 22 having the relatively long driver elements 26-6 through 26-9, for acting upon such tumblers. The foregoing spring match-ups or combinations with the tumblers 22 are maintained in the various lock codes, as illustrated for the lock code of FIG. 7. The basic condition of the invention as regards the springs 24 is that there be in each individual lock mechanism 10 at least one spring which has a relatively high spring rate acting upon a tumbler 22 having a relatively short driver element 26, and at least one spring 24 which has a relatively low spring rate acting upon a tumbler 22 having a relatively long driver element 26.

The number of springs of each spring rate and their combinations with the tumblers 22 may be varied from the illustrative example. Providing two groups of springs of different rates, as exemplified, gives excellent pick-resistance. At the same time, inventory, supply and assembly requirements are minimized by employing but two different springs. On the other hand, springs 24 having a greater number of spring rates may be employed in individual lock mechanisms 10, to further increase the difficulty of picking. For example, use may be made of springs 24 in three different spring rates, with each of the three springs matched with a different group of three tumblers 22 of the series illustrated in FIG. 6. Lock codes may be selected for use so as to include one of each of the three springs in each individual lock mechanism 10, or, if desired, a greater number of lock codes may be employed, wherein all three springs are present in some individual lock mechanisms 10 and two of the three springs are present in other individual lock mechanisms 10.

The differences in spring rate of the springs 24 may be provided in various ways, such as described in the above-identified U.S. Pat. No. 3,270,538. In a preferred construction, as illustrated in the drawings, SPRINGS I and II are constructed alike but made of different metals, which provide different spring rates, in accordance with known principles. In the illustrative preferred embodiment of the invention, SPRING I is constructed of stainless steel, and SPRING II is constructed of phosphor bronze. The springs in their relaxed state have the same length, as represented by the legend "LENGTH B" in FIG. 6. Use of two springs of the same size has obvious advantages in the manufacture of the lock mechanism 10. The springs also have the same number of coils, coil diameters, and wire diameters. However, the springs 24 need not have uniform dimensions, or be made of different materials, so long as the springs are constructed to provide at least two spring rates in the springs which are used in each individual lock mechanism.

It is preferred that one of the springs 24 of different spring rates have a compression resistance at least about 30% greater than at least one other spring, measured at approximately 50% compression. It is further preferred that the range of compression resistance from the spring having the lowest spring rate to the spring having the highest spring rate be within about 60% of the resistance of the spring having the lowest spring rate, measured at approximately 50% compression.

In the illustrative preferred embodiment of the invention, the springs 24 have a length, LENGTH B, of 0.315±0.010", and a coil diameter of 0.071-0.076". The springs have twelve coils with closed coils on each end, and the wire diameter is 0.011". The compression resistance, as referred to above and in the claims, and constituting a measure of the spring rate, is determined by compression to 0.150". Determined in this manner, the compression resistance of exemplary SPRING I is 13 ounces or 368.525 grams, and the compression resistance of exemplary SPRING II is ten ounces or 283.480 grams. Thus, SPRING I, having the higher spring rate, has a compression resistance 30% greater than the resistance of SPRING II. As an example of a combination of springs providing springs of three different rates, the foregoing springs I and II may be used together with a spring having a compression resistance measured in the same way of 16 ounces, providing the preferred range of compression resistance set forth above, i.e., within about 60% of the resistance of SPRING II, having the lowest spring rate. In the illustrative embodiment, the tumbler bores 68 and 74 have a diameter of 0.082", and the stationary part bores 74 have a depth of 0.390". The overall length of the tumblers 22, LENGTH A, is 0.450±0.002".

Figure 1:
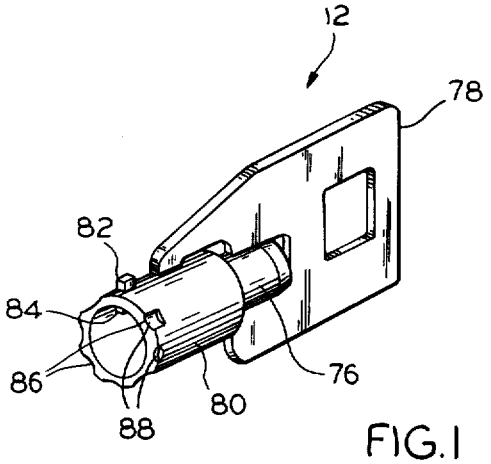
FIG. 1 is a perspective view of a key which cooperates with the lock mechanism of FIG. 2.

Referring to FIG. 1, the key 12 is a conventional structure, which includes a body 76 connected to a wing-type torque-applying or manipulating handle 78. The body includes a cylindrical tubular shank 80 having an inside diameter slightly greater than the diameter of the post 62. Adjacent to the outer end of the shank 80, a longitudinally extending guide lug 82 extends radially outwardly from the shank, and a longitudinally extending drive lug 84 extends radially inwardly from the shank. Transversely arcuate grooves 86 are formed in the outer surface of the shank 80, and they extend longitudinally from the outer end thereof and terminate in bittings or shoulders 88. The grooves 86 and the corresponding bittings 88 each are seven in number and spaced apart at angles of 45°, except for two of them, which are on opposite sides of the lugs 82 and 84 and angularly spaced apart 90°.

As seen in FIGS. 2 and 3, the key guide notch 52 and the drive notch 66 are radially aligned when the lock mechanism 10 is in its initial, locking condition. The key 12 is inserted in the lock mechanism 10 by inserting the shank 80 in the key opening 48 and around the guide post 62. The guide lug 82 on the key is inserted in the guide notch 52 in the closure flange 46, and the drive lug 84 is inserted in the drive notch 66 in the post 62. As illustrated in FIG. 5, the tumbler driver elements 26 in part are received in the key grooves 86, and the front ends of the driver elements abuttingly engage the key bittings 88. Movement of the key 12 towards the rear end 40 of the lock cylinder 14 moves the tumblers 22 in aligned tumbler bores 68 and 74 rearwardly, until the shank 80 of the key bottoms on the head 60 of the operating part 18. At this time, the tumbler joints coincide with the interfacial plane 72, and the guide lug 82 on the key is disposed rearwardly of the closure flange 46, so that the operating part 18 may be rotated by rotation of the key, to thereby operate the lock.

In the illustrative embodiment of a "cam lock", a stop disc 90 and a locking plate or arm 92 are mounted on the rear end of the lock shaft 58 for rotation therewith. Thus, the shaft 58 having the flats 64 extends through similary contoured oblong openings in the stop disc 90 and the locking plate 92. The rear extremity of the lock shaft 58 is screw-threaded, for threaded engagement with a nut 94 thereon, which secures the stop disc 90 and the locking plate 92 on the shaft. The stop disc 90 is a conventional manner, having a circumferentially spaced pair of shoulders 95, one of which is seen in FIG. 4. The disc shoulders 95 alternately abut on the respective stop shoulders **56*a* and 56*b* of the lock cylinder extension 56, upon rotation of the lock shaft 58 in opposite directions through an angle of 90°. The locking plate 92 thus may be rotated 90° in opposite directions, from a locking position in which the locking plate engages a panel or other member, to an unlocking position in which the locking plate is clear of such member. In the illustrative embodiment, insertion of the key 12 into the lock mechanism and clockwise rotation through an angle of 90° places the locking plate 92** in its unlocking position.

The appearance and normal operation of the lock mechanism 10 are like those of prior lock mechanisms. However, the picking characteristics are entirely different, owing to the above-described structural combination of tumblers and tumbler springs. The pick-resistant structure may be employed not only in the illustrative lock mechanism 10 and similar mechanisms having two-part barrel assemblies, including a unitary rotatable part and a unitary stationary part, and tumblers constituted of two tumbler elements or pins, but also in lock mechanisms having additional barrel assembly parts or the like, and one or more additional elements in each tumbler. For example, the invention is applicable to the lock mechanism of my U.S. Pat. No. 3,916,657, a double key lock having two rotatable parts and one stationary part in a barrel assembly, and three elements in each tumbler. In this structure, the two outer tumbler elements (numbered 86 and 88) together are considered to be the "driver element" referred to herein, in measuring lengths. The present invention is directed to preventing relative rotation between the intermediate spindle part (54) and the rear sleeve part (50), while the front drive part (56) is connected to the spindle part (54) and rotated therewith, by operation of a picking tool. Thus, the lock would be prevented from operating in its normal manner, as illustrated in FIG. 7 of the patent, by picking rather than by the proper key.

Another structure to which the invention is similarly applicable is shown in Kerr U.S. Pat. No. Re. 28,319. The lengths of the upper and lower case lettered tumbler pins in the patent are combined in measuring the "driver element" referred to herein, and the present invention is employed to resist picking to produce relative rotation at the interfacial plane 1—1. An example of a lock mechanism in which the tumblers each have three elements, and only the outer element of each is measured as the "driver element" referred to herein, is the master key mechanism illustrated on page 7 of Catalog 176 of Chicago Lock Co. (Copyright 1976). Employing the present invention in this manner, resistance is imparted to picking the lock by placing the tumblers in the positions normally resulting from operation of the master key. In each of the foregoing examples, spring means having at least two different spring rates are matched with the long and short driver elements determined as described for the examples, to provide the above-described structure of the present invention.

While a preferred embodiment of the invention has been illustrated and described, reference has been made to certain changes and modifications which may be made therein, and additional applications of the invention have been described, it will be apparent that other changes, modifications, and applications may be made within the spirit and scope of the invention. It is intended that all such changes, modifications, and applications be included within the scope of the appended claims.

I claim:

1. In an axial split-pin tumbler-type lock mechanism, said mechanism including a lock cylinder, a barrel assembly secured within said cylinder and having a longitudinal axis extending between front and rear ends thereof, said barrel assembly including a forwardly disposed operating part rotatable about said axis and a rearwardly disposed stationary part adjoining the operating part at a transverse interfacial plane, means forming longitudinal bores in said operating and stationary parts, respectively, and disposed radially outwardly of said axis therearound, said bore-forming means in respective parts being relatively movable into and out of longitudinal alignment of their bores upon rotation of said operating part, tumblers each including a forwardly disposed driver element carried in one of said operating part bores and a separate rearwardly disposed follower element carried in one of said stationary part bores with the elements adjoining each other when in aligned bores, said tumblers each being reciprocally movable in the axial direction in aligned bores between respective positions wherein the joint between said elements thereof is disposed on opposite sides of said interfacial plane, said operating and stationary parts being secured against rotation relative to each other when at least one of said tumbler elements bridges said interfacial plane and being rotatable relative to each other when said tumbler joints coincide with said interfacial plane, and spring means yieldingly urging said tumblers in aligned bores forwardly to positions wherein said interfacial plane is bridged by a plurality of said follower elements, said driver elements having front ends engageable with a key, whereby rearward movement of the key moves said tumblers in aligned bores rearwardly to positions wherein said tumbler joints coincide with said interfacial plane, the improvement for obtaining increased pick-resistance which comprises providing said tumblers in substantially equal overall lengths, said tumblers including at least two tumblers having driver elements differing in length, and providing said spring means in at least two different spring rates respectively to act upon said tumblers having elements differing in length, one of said spring means which has a relatively high spring rate acting upon a tumbler having a relatively short driver element, and another of said spring means which has a relatively low spring rate acting upon a tumbler having a relatively long driver element.

2. A lock mechanism as defined in claim 1 and wherein said spring means comprise coil compression springs which are substantially equal in length and the materials of construction of which differ among them to provide said different spring rates.

3. A lock mechanism as defined in claim 1 and wherein said tumbler elements have substantially cylindrical bodies, and any end projections from said bodies are limited to substantially spherically rounded crowns.

4. A lock mechanism as defined in claim 3 and wherein said crowns have a minimum radius of curvature of about 3/32 inch.

5. A lock mechanism as defined in claim 3 and wherein said spring means comprise coil compression springs which are substantially equal in length and the materials of construction of which differ among them to provide said different spring rates.

6. A lock mechanism as defined in claim 1 and wherein said spring means comprise coil compression springs at least one of which has a compression resistance at least about 30% greater than at least one other spring, measured at approximately 50% compression.

7. A lock mechanism as defined in claim 6 and wherein the range of compression resistance from the spring having the lowest spring rate to the spring having the highest spring rate is within about 60% of the resistance of the spring having the lowest spring rate, measured at approximately 50% compression.

8. A lock mechanism as defined in claim 6 and wherein said springs are substantially equal in length, and the materials of construction of said springs differ among the springs to provide said different spring rates.

9. A lock mechanism as defined in claim 6 and wherein said tumbler elements have substantially cylindrical bodies, and any end projections from said bodies are limited to substantially spherically rounded crowns.

10. A lock mechanism as defined in claim 9 and wherein said springs are substantially equal in length, and the materials of construction of said springs differ among the springs to provide said different spring rates.

11. A lock mechanism as defined in claim 10 and wherein said crowns have a minimum radius of curvature of about 3/32 inch.

* * * * *